US012622472B1

(12) United States Patent
Payton et al.

(10) Patent No.: US 12,622,472 B1
(45) Date of Patent: May 12, 2026

(54) SPORT PROTECTIVE GUARD

(71) Applicants: David J. Payton, Orland Park, IL (US); Daniel R. Oriente, Downers Grove, IL (US)

(72) Inventors: David J. Payton, Orland Park, IL (US); Daniel R. Oriente, Downers Grove, IL (US)

(73) Assignee: Jax Athletics, LLC, Tinley Park, IL (US)

( * ) Notice: Subject to any disclaimer, the term of this patent is extended or adjusted under 35 U.S.C. 154(b) by 0 days.

(21) Appl. No.: 18/916,344

(22) Filed: Oct. 15, 2024

Related U.S. Application Data

(60) Provisional application No. 63/544,563, filed on Oct. 17, 2023.

(51) Int. Cl.
*A41D 13/08* (2006.01)
*A41D 13/06* (2006.01)

(52) U.S. Cl.
CPC ..... *A41D 13/08* (2013.01); *A41D 13/06* (2013.01)

(58) Field of Classification Search
CPC .. A41D 13/081; A41D 19/00; A41D 13/0543; A63B 71/143; A63B 2071/1258
See application file for complete search history.

(56) References Cited

U.S. PATENT DOCUMENTS

| | | | | |
|---|---|---|---|---|
| 4,068,312 | A * | 1/1978 | Ledesma | A41D 13/065 2/24 |
| 4,700,404 | A * | 10/1987 | Potvin | A63B 71/143 2/161.1 |
| 5,007,108 | A * | 4/1991 | Laberge | A41D 13/0518 2/463 |
| 5,655,221 | A * | 8/1997 | Worischeck | A63B 71/12 2/16 |
| 6,085,352 | A * | 7/2000 | Martin | A63B 71/143 2/16 |
| 7,200,872 | B2 * | 4/2007 | Gregory | A41D 13/08 2/170 |
| 7,937,768 | B2 | 5/2011 | Behrend et al. | |
| 9,555,312 | B2 | 1/2017 | Machado | |
| 10,773,149 | B2 | 9/2020 | Hammer | |
| 10,850,181 | B2 | 12/2020 | Restko et al. | |
| 2014/0259258 | A1 | 9/2014 | Miranda | |
| 2016/0050989 | A1 * | 2/2016 | Sheu | A41D 13/081 2/24 |

FOREIGN PATENT DOCUMENTS

| | | | | |
|---|---|---|---|---|
| WO | WO-2017051200 | A1 * | 3/2017 | A41D 31/12 |

* cited by examiner

*Primary Examiner* — Tajash D Patel
(74) *Attorney, Agent, or Firm* — Paul J. Nykaza; Schacht Law Office, Inc.

(57) ABSTRACT

A protective guard has a protective layer configured to be worn by a user. The guard has a first configuration configured to be worn on one of an arm of the user and a leg of the user. The guard also has a second configuration configured to be worn on a hand of the user.

10 Claims, 8 Drawing Sheets

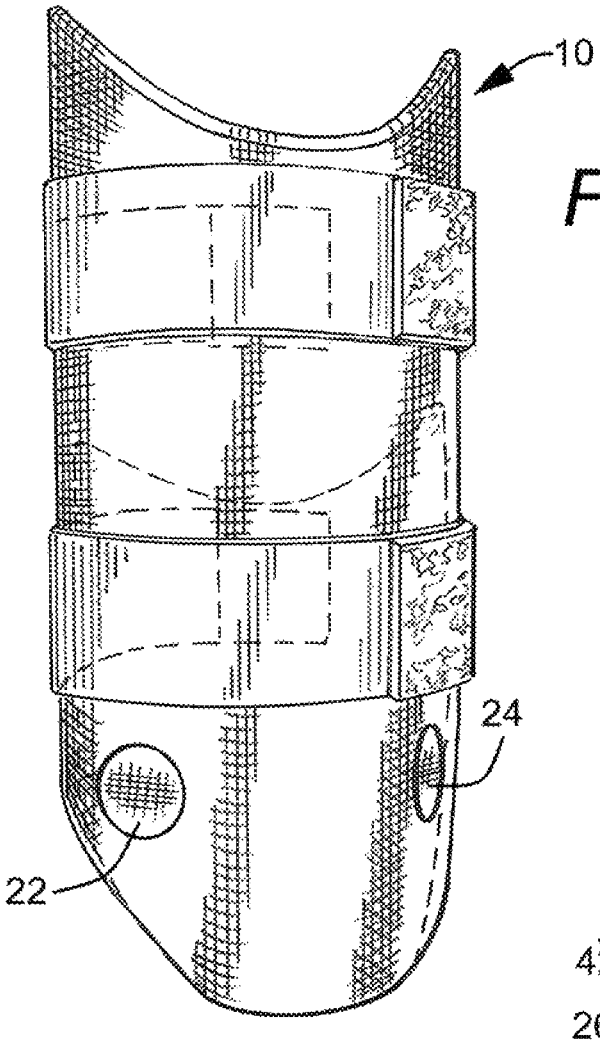
FIG. 7
FIG. 8
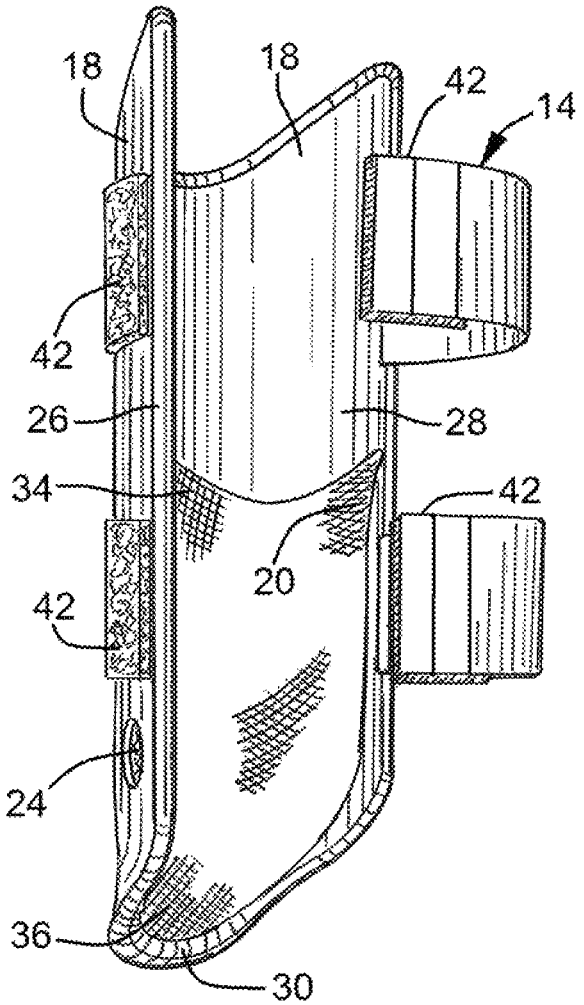

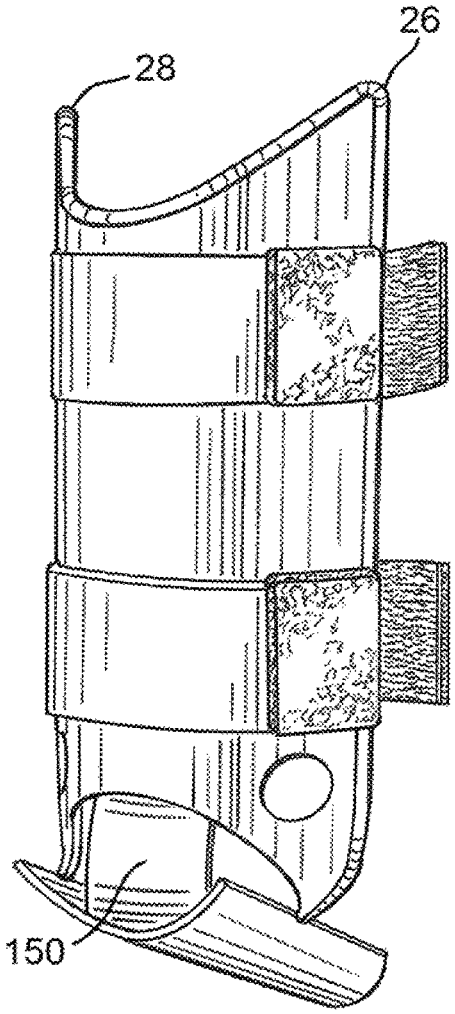
FIG. 14
FIG. 15
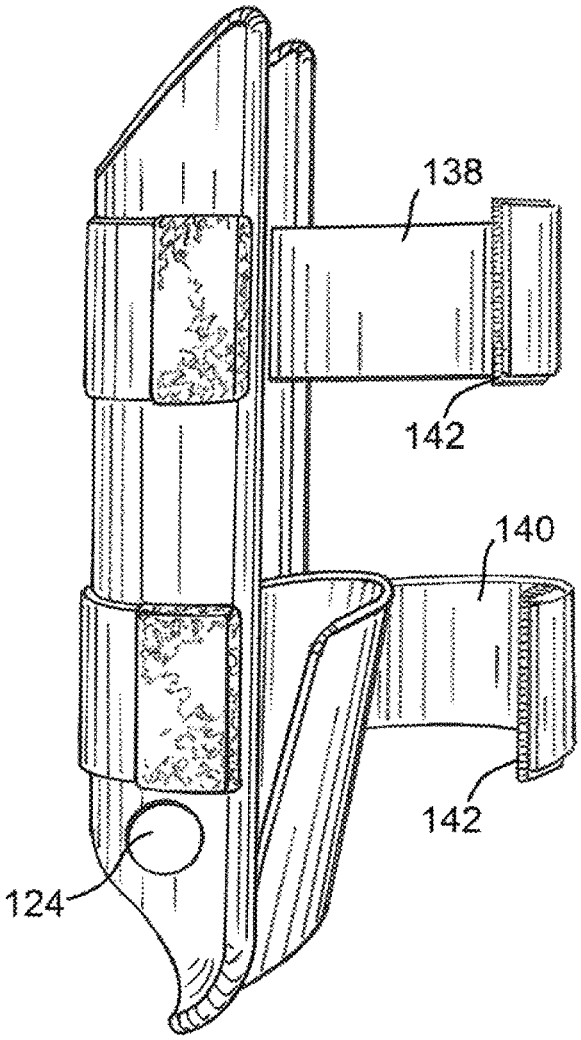

SPORT PROTECTIVE GUARD

CROSS-REFERENCE TO RELATED APPLICATIONS

The present application claims the benefit of U.S. Patent Application No. 63/544,563, filed on Oct. 17, 2023, which application is incorporated by reference in its entirety herein and made a part hereof.

FEDERALLY SPONSORED RESEARCH OR DEVELOPMENT

None.

TECHNICAL FIELD

The invention relates generally to a sport protective guard and, more particularly, an elbow guard or leg guard that also functions as a sliding guard for the user.

BACKGROUND OF THE INVENTION

Various types of protective sports equipment have been developed over the years and are known in the art. The protective sports equipment can vary widely depending on the type of sport and the environments and circumstances experienced by athletes participating in the various sports. For example, helmets are widely used in baseball, softball, football, lacrosse and hockey. Additional types of protective equipment have been developed over time for baseball and softball athletes. While hitting in baseball and softball, the hitter often wears an elbow guard and/or a leg guard or shin guard. The elbow guard protects the hitter's elbow and additional portions of the arm in case of being hit with a pitched ball. Increased strength, athleticism and skill has increased overall pitching velocity, and some hitters prefer to stand closer to home plate, which circumstances have contributed to more hitters wearing elbow guards. A hitter may also wear a leg guard or shin guard proximate a lower leg and foot to prevent injury from a mishit ball (e.g., a foul ball) hitting the shin or foot. Elbow and leg guards are made from various types of materials and have various types of constructions and features. Once a hitter reaches base, the athlete typically removes the elbow guard and/or shin guard and gives such equipment to a base coach, as such guards are unnecessary when running the bases.

Another type of protective equipment is a sliding guard or sliding mitt. When running bases, a risk exists of being hit with a thrown ball, colliding with a base while sliding or also colliding with a fielder while sliding into a base. The runner can also injure a hand or finger(s) when being tagged with a caught ball by a fielder. In view of these risks, runners have also worn gloves while running the bases to protect hands. In more recent times, sliding guards, or sliding mitts have been developed wherein a guard defines a pocket or compartment to cover a hand of a runner to minimize injury while running bases. A hitter may typically keep such gloves or sliding guard in a back pant pocket while hitting.

These various types of protective gear have helped minimize injury for hitters and baserunners. The elbow guards and shin guards have various constructions where some designs are bulky and cumbersome in use. Thus, it is desirable to remove such equipment immediately upon reaching base. Now a baserunner, the athlete will then put on a glove or sliding guard for running the bases. Thus, the hitter/runner may have multiple types of protective equipment to manage and keep track of, which can be inefficient and cumbersome during play. There remains a need to make the use of such protective equipment more effective and efficient such as equipment having multiple uses for players.

While sport protective equipment such as elbow guards, leg guards and sliding guards according to the prior art provide a number of advantageous features, they nevertheless have certain limitations. The present invention is provided to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY OF THE INVENTION

The present invention provides a sport protective equipment having multiple uses for an athlete.

According to a first aspect of the invention, a protective guard has a first configuration worn by a hitter as an elbow guard and a second configuration worn by the hitter as a hand protector while running bases.

According to another aspect of the invention, a protective guard has a first configuration worn by a hitter as a leg guard and a second configuration worn by the hitter as a hand protector while running bases.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which:

FIG. 7, is a schematic front perspective view of the protective guard of FIG. 5;

FIG. 8 is a rear perspective view of the protective guard of FIG. 5;

FIG. 14 is a front perspective view of the protective guard of FIG. 13 showing an external layer in an intermediate state;

FIG. 15 is a side elevation view of the protective guard of FIG. 13 showing the external layer in proximate position to function as a sliding guard; and, FIGS. 16A-16D show a progression of views of the protective guard of FIG. 13 in a configuration to function as a leg guard and transitioning to a configuration to function as a sliding guard.

DETAILED DESCRIPTION OF THE PREFERRED EMBODIMENT

Figure 1:
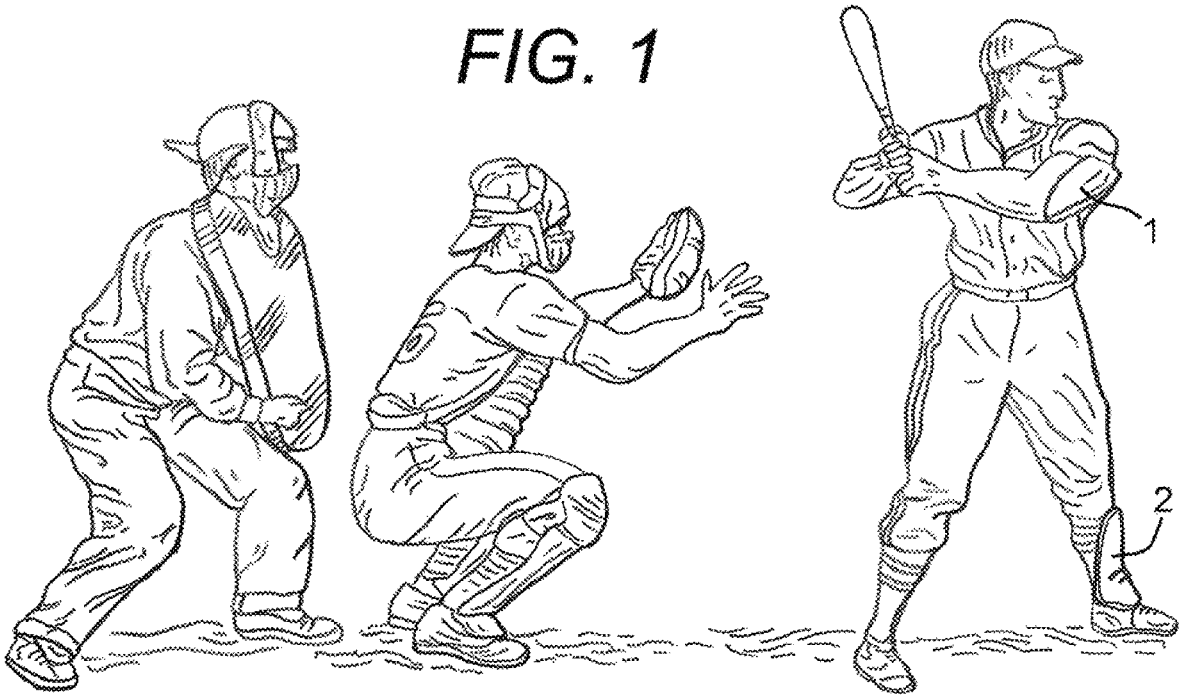
FIG. 1 is a view of a baseball hitter wearing sport protective equipment in the form of an elbow guard and a leg guard according to the prior art.

While this invention is susceptible of embodiments in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
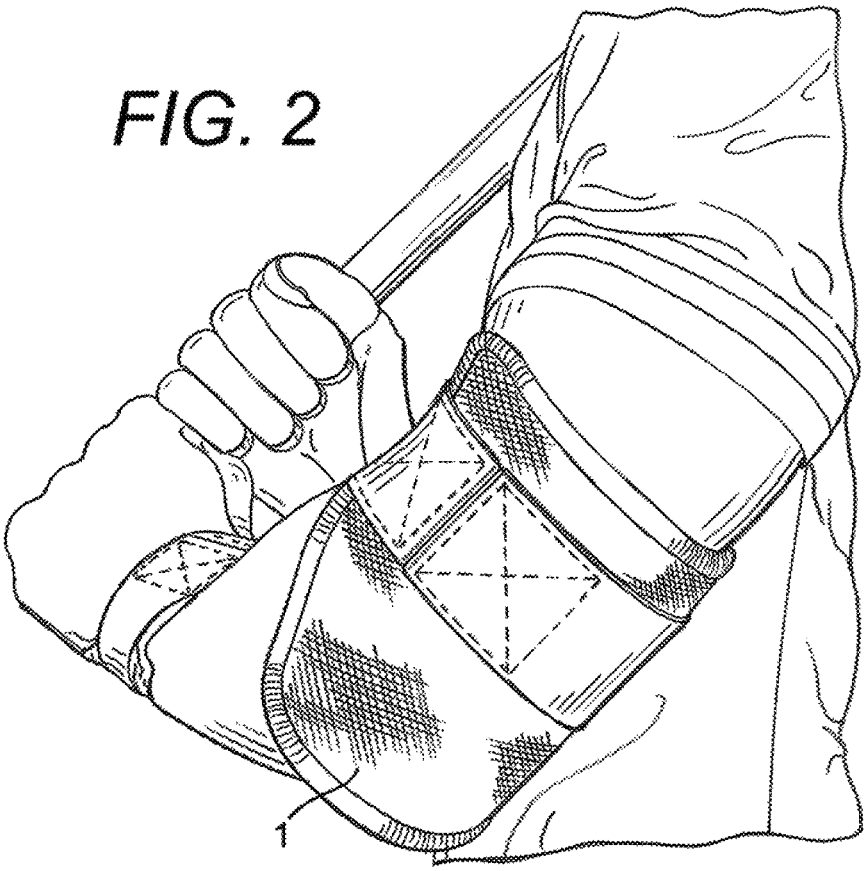
FIG. 2 is a partial view of a baseball hitter wearing an elbow guard according to the prior art.
Figure 3:
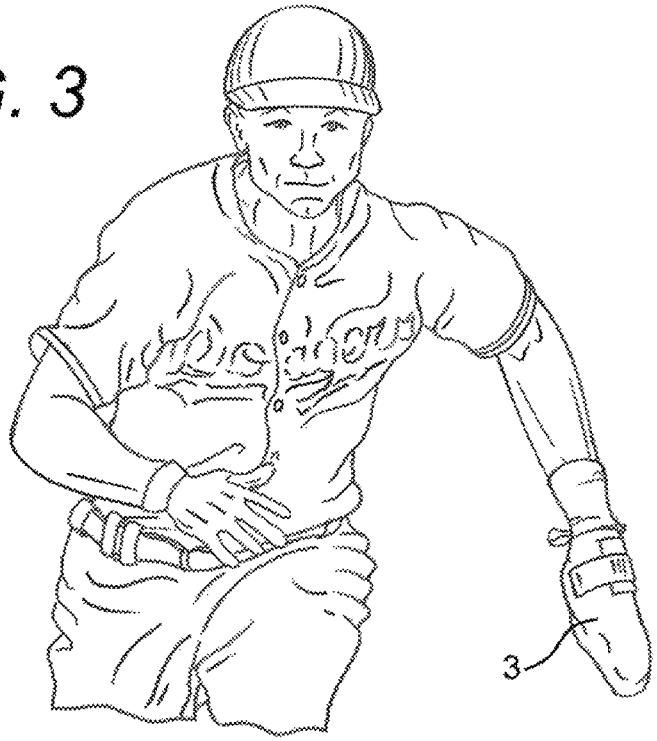
FIG. 3 is a baseball baserunner wearing sport protective equipment in the form of a sliding glove or sliding mitt according to the prior art.
Figure 4:
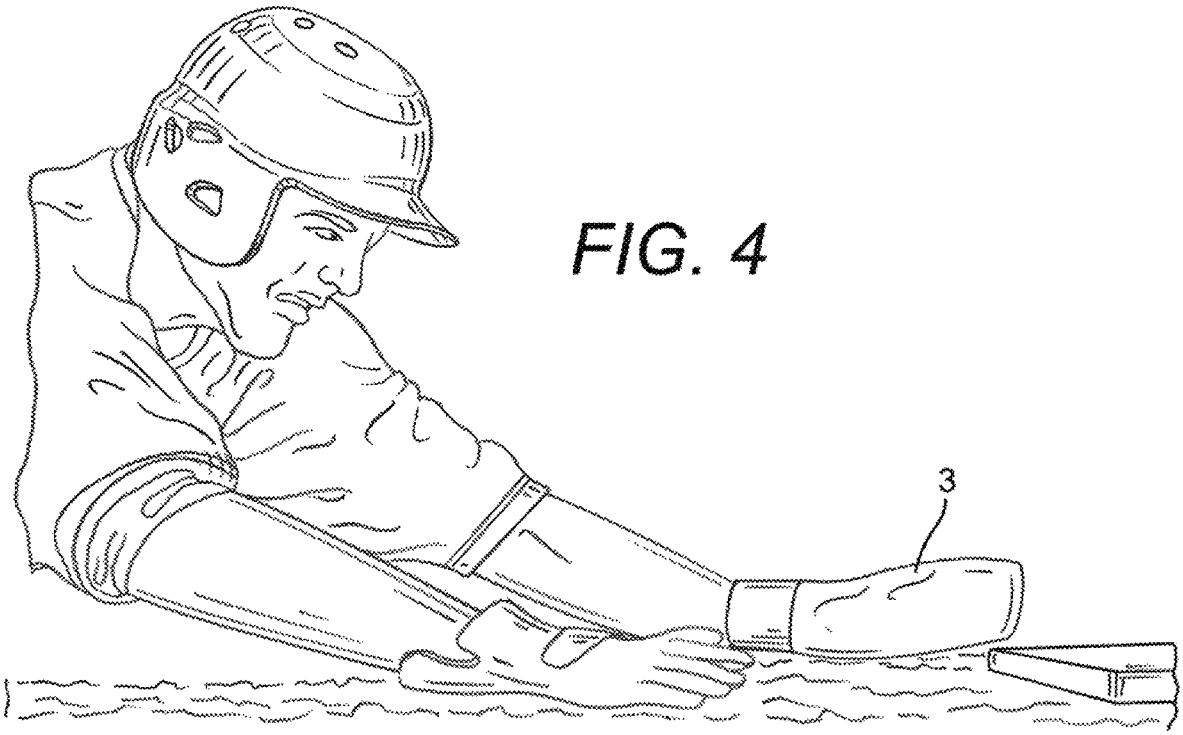
FIG. 4 is a partial view of a baseball baserunner wearing a sliding guard or sliding mitt according to the prior art and sliding into a base.
Figure 5:
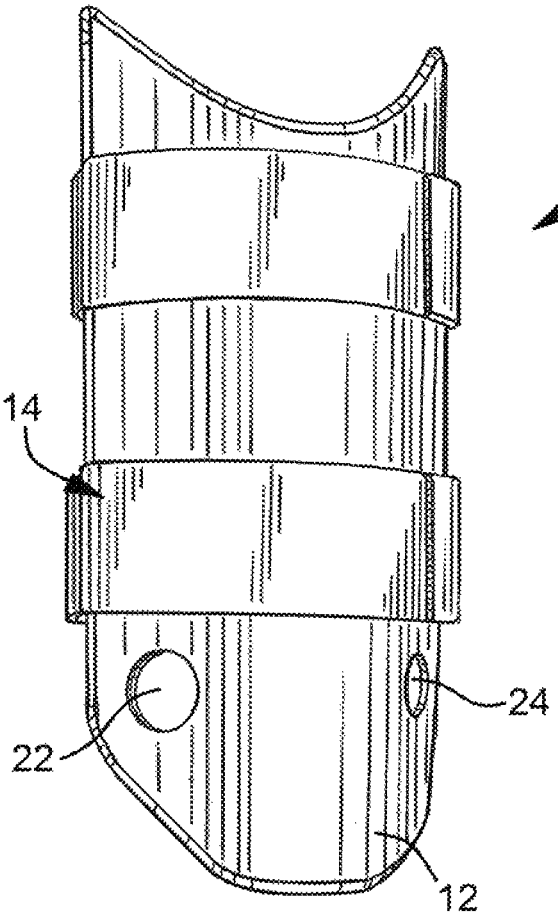
FIG. 5 is a front perspective view of an example sport protective equipment in the form of a protective guard that functions as both an elbow guard in a first configuration and a sliding guard in a second configuration.
Figure 6:
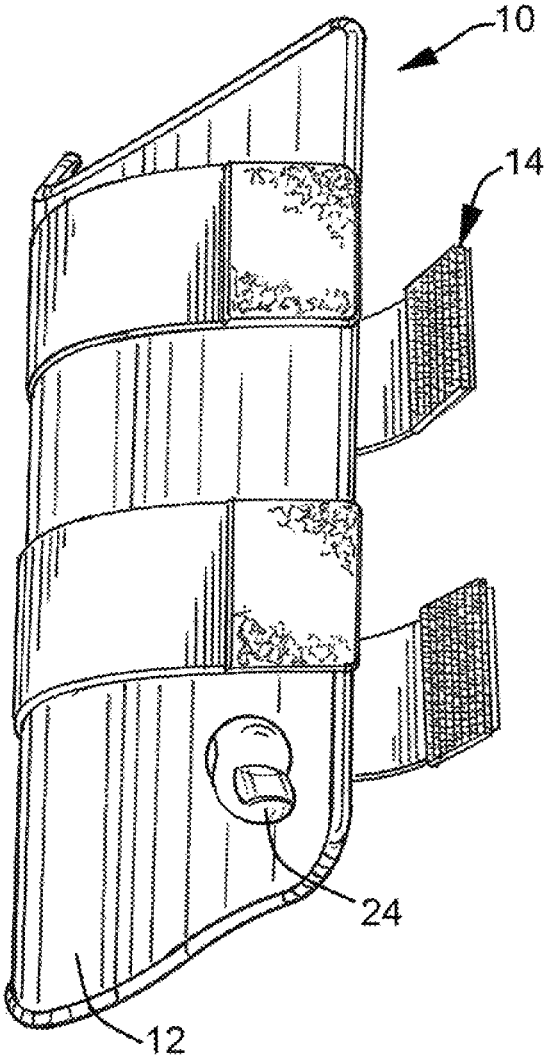
FIG. 6 is a side elevation view of the protective guard of FIG. 5.
Figure 11:
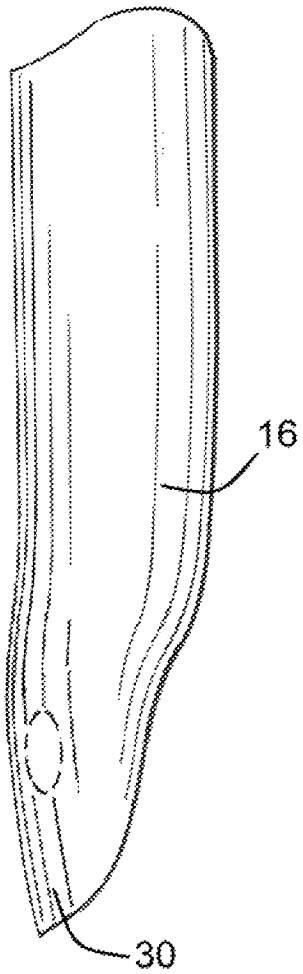
FIG. 11 is a side elevation view of the protective layer of FIG. 10.

Referring to the drawings, FIGS. 1-4 disclose various views of sport protective equipment often used in the game of baseball or softball. It is understood that sport protective equipment take various forms depending on the sport and particular desires of players participating in the sport. FIG. 1 shows a baseball hitter in a batter's box and preparing to hit a pitched ball. The hitter is wearing a prior art elbow guard 1 and a prior art leg guard 2. FIG. 2 shows another view of a baseball hitter wearing a prior art elbow guard. FIG. 3 shows a baseball baserunner wearing a prior art sliding guard 3. FIG. 4 shows a baserunner wearing a prior art sliding guard and sliding head first into a base.

FIGS. 5-12 disclose an exemplary embodiment of sport protective equipment in the form of a protective guard, generally designated with the reference numeral 10. As described in greater detail below, the protective guard 10 is an elbow guard in a first configuration, and the protective guard 10 is a sliding guard in a second configuration. In the specific first configuration, the elbow guard is designated with the reference numeral 10*a*. In the specific second configuration, the leg guard is designated with the reference numeral 10*b*. The structure of the protective guard 10 will first be described followed by a description of the operation of the protective guard 10 in its multiple configurations. As further shown in FIGS. 5-12, the protective guard 10 generally has a base member 12 and a connector assembly 14.

Figure 10:
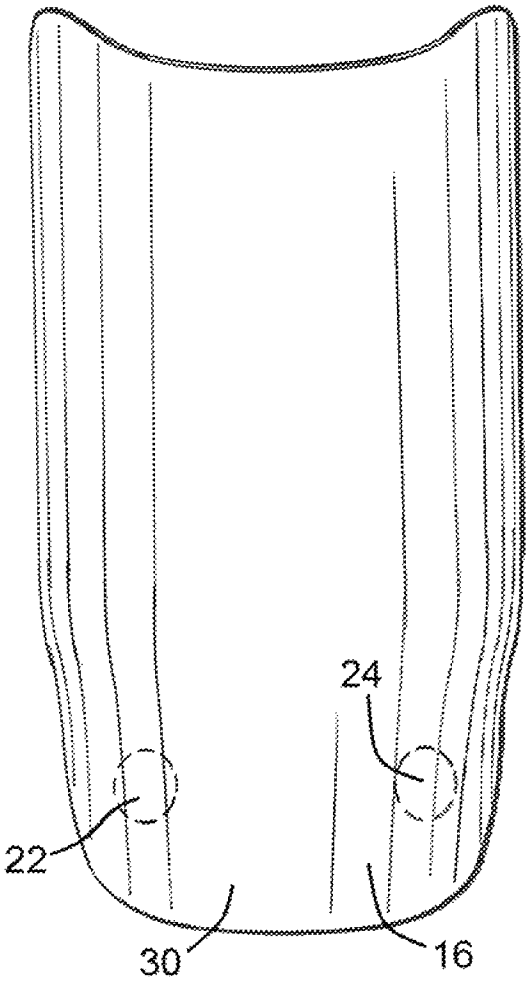
FIG. 10 is front elevation view of a protective layer of the protective guard of FIG. 5.
Figure 9:
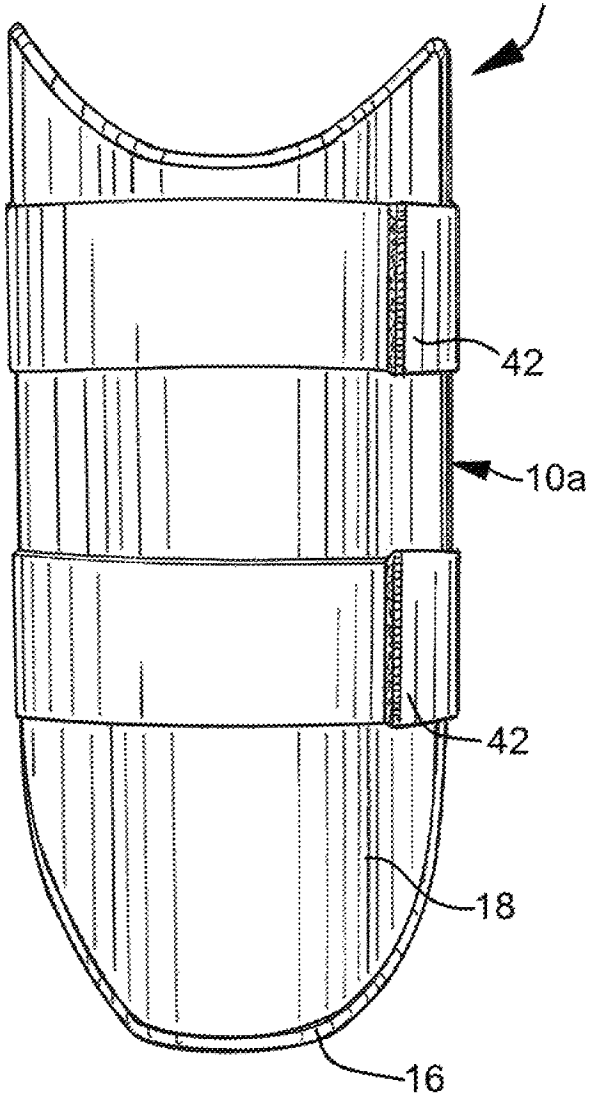
FIG. 9 is a front elevation view of an alternative embodiment of the protective guard of FIG. 5.
Figure 12:
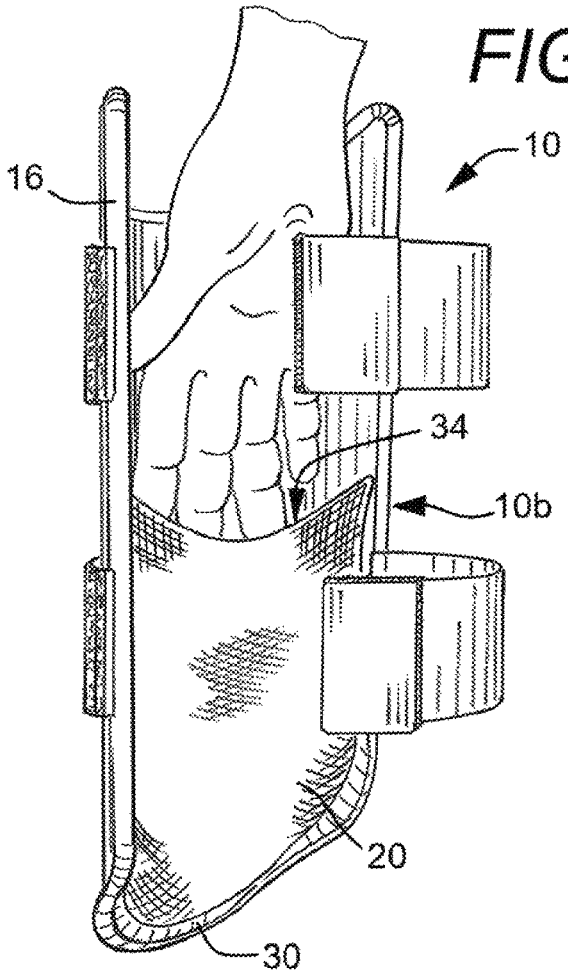
FIG. 12 is a rear perspective view of the protective guard of FIG. 5 showing an athlete inserting a hand into a pocket of the protective guard.
Figure 13:
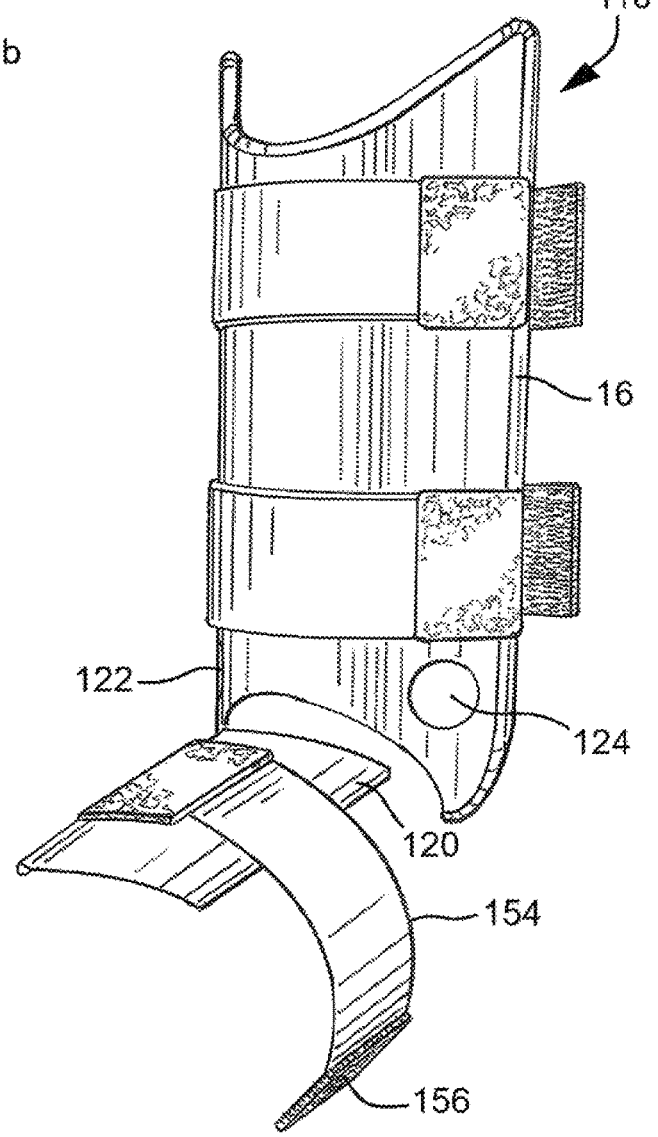
FIG. 13 is a front perspective view of another embodiment of the protective guard of the present invention that functions as both a leg guard in a first configuration and a sliding guard in a second configuration.
Figure 16A:
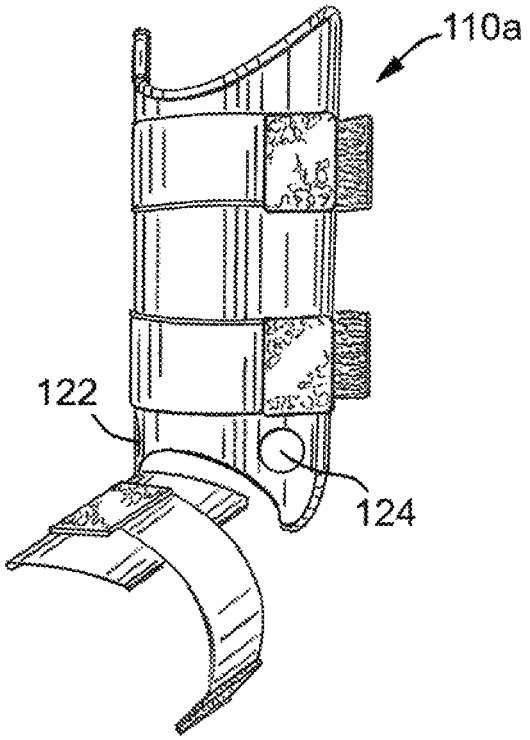
Figure 16B:
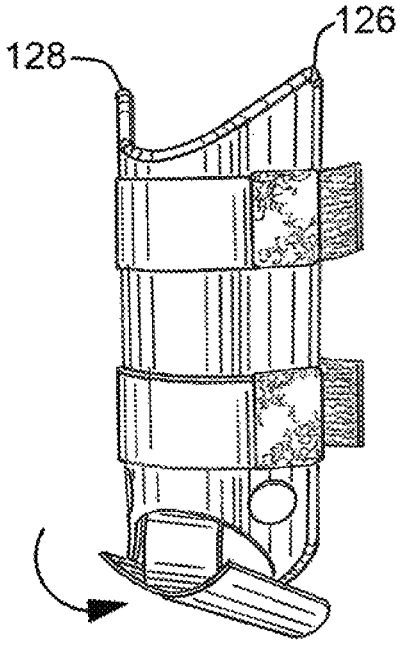
Figure 16C:
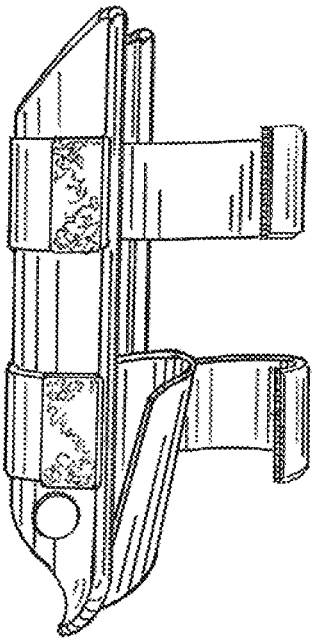
Figure 16D:
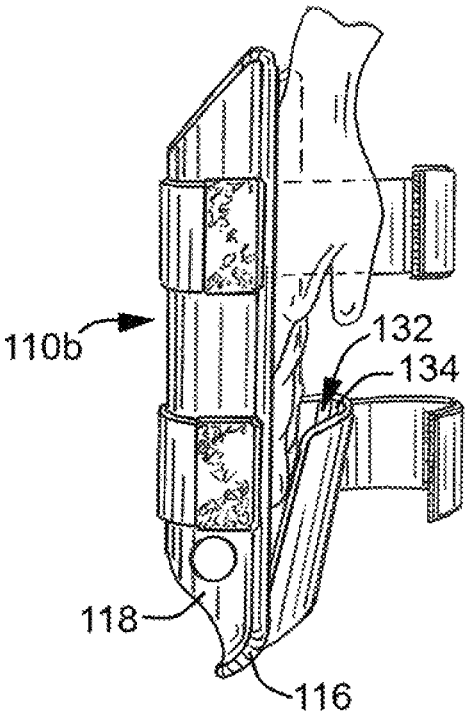

As further shown in FIGS. 5-10, the base member 12 generally includes a protective layer 16, a cover member 18 and an external layer 20. As shown in FIG. 10, the protective layer 16 is a rigid plate-type member made from a hard plastic in an exemplary embodiment. The protective layer 16 is contoured to fit around a limb of a player. In this embodiment, the protective layer 16 has a curvature to receive an upper arm of the player such as understood from FIG. 2. As can be appreciated from FIGS. 5-10, the protective layer 16 has a first aperture 22 and a second aperture 24 therethrough. The apertures 22,24 are shown schematically in FIG. 10 as in certain alternative embodiments, the apertures 22,24 are not present through the protective layer 16. FIG. 9, for example, shows the protective guard 10 wherein the apertures 22,24 are not present in the guard 10. The curvature of the protective layer 16 ends in a first longitudinal side 26 and a second longitudinal side 28. The protective layer 16 further defines a distal extension 30 for further protection of an elbow of a player to be described in greater detail below.

As discussed, the protective layer 16 is a rigid layer 16 such as made from hard plastic material. Thus, the protective layer 16 is formed from materials that can protect the limb of the player from a pitched ball or foul ball depending on the use of the protective layer 16. The protective layer 16 can be formed in a three-dimensional printing process in an exemplary embodiment. The protective layer 16 can also be formed of other materials if desired. The protective layer 16 can also be formed from a material having an initial flexible state that becomes rigid after being formed and set around a limb of a player. In other alternative embodiments, it is understood that the protective layer 16 can be formed from a plurality of adjacent guard members supported on a flexible membrane. The flexible membrane conforms to the curvature of a limb of a player and the guard members are positioned such that a pitched ball or foul ball engages the guard members and not the limb of the player.

The protective layer 16 could also be formed of a resiliently compressible material that may be considered a smart or intelligent material. The resiliently compressible material has shock absorbing properties that assist in cushioning impacts from thrown balls, hit balls or other types of collisions. The compressible material may be a polyurethane energy-absorbing material containing certain additives and a dilatant non-Newtonian fluid such as polyborodimethylsiloxane (PDBMS). In this particular embodiment, the material is a closed cell polyurethane foam composite with PDBMS as the dilatant dispersed through the foam matrix and further includes a fluid also dispersed therein. The material is further described in U.S. Pat. No. 7,381,460 which is incorporated herein by reference. The material is an energy absorbing composite material having a solid foamed synthetic polymer matrix, and a polymer-based dilatant that is distributed through the polymer of the matrix and incorporated into the polymer of the matrix during formation of the polymer matrix, and a fluid distributed through the matrix. The combination of the matrix, dilatant and fluid provides a composite material that is flexible and resiliently compressible.

The cover member 18 is a flexible layer that is dimensioned to cover the protective layer 16. It is understood that the cover member 18 can be dimensioned to fully encase the protective layer 16 or partially cover the protective layer 16. For example, the cover member 18 can be dimensioned to cover front and back surfaces of the protective layer 16 and not cover sides of the protective layer 16 around a perimeter of the layer 16. The cover member 18 has apertures to correspond to the first aperture 22 and the second aperture 24 through the protective layer 16. The cover member 18 can be made from various types of material including suede fabric, leather materials, or Spandex or Lycra materials, nylon materials, other resilient materials or combinations thereof. The cover member 18 generally conforms to the overall shape and curvatures of the protective layer 16 thus forming a multi-layer construction.

FIG. 8 shows the external layer 20 or spanning layer 20. The external layer 20 is connected to the cover member 18 at the first longitudinal side 26 and the second longitudinal side 28 thus spanning across the protective member 16. The external layer 20 is also connected to the cover member 18 at the distal extension 30. Thus, a pocket 32, or compartment 32, is formed cooperatively between the protective layer 16 and the external layer 20, and in particular between the inner surface of the protective layer 16 and the inner surface of the external layer 20. The pocket defines an opening 34 at an intermediate location of the guard 10 and defines a closed end 36 at the distal extension 30. It is understood that the connection of the external layer 20 can also extend directly to the protective layer 16 if desired.

The external layer 20 is a flexible layer, but designed to have considerable strength. The external layer 20 can be made from heavy-duty Spandex or Lycra materials and other tear-resistant materials. Thus, the external layer 20 has significant resilient flexibility and significant tear-resistance.

FIGS. 5-10 further show the connector assembly 14 that functions to mount the guard 10 on the user or player to be described. The connector assembly 14 has a first strap 38 spaced from a second strap 40. Each strap 38,40 has a proximal end attached to the cover member 18 generally at a front section of the guard 10. The straps 38,40 further have connector members in the form of hook and loop fasteners 42 that secure the straps 38,40 around a limb of a player to be described. In further embodiments, hook portions of the straps are connected to the cover member and loop portions are positioned on distal ends of the straps wherein the straps wrap around a limb of a player and the hook and loop portions engage with one another. It is understood the hook and loop portions can be mounted in reverse if desired. Other types of connections could also be employed if desired such as buckles or ties etc.

In operation and as discussed, the protective guard 10 functions in multiple uses for players. In a first configuration, the protective guard 10 is used by a player when hitting as an elbow guard, designated with the reference numeral 10*a*. Thus, prior to entering the batter's box to hit, the player mounts the elbow guard 10*a* around a front arm that faces the oncoming ball such as shown in FIGS. 1-2. A right-handed hitter mounts the elbow guard 10*a* on a left arm and a left-handed hitter mounts the elbow guard 10*a* on a right arm. The first and second straps 38,40 wrap around the upper arm and the hook and loop fasteners 42 secure the straps 38,40 to mount the elbow guard 10*a* on the upper arm. It is understood that the external layer 20 is flexible and conforms around the upper arm of the player. The elbow guard 10*a* thus protects the player's upper arm when hitting. It is further understood the distal extension 30 provides additional protection for the elbow. The player may reach base via a variety of outcomes such as a hit, a fielder's choice, a fielding error, a base on balls, or a hit by pitch. Upon reaching base, the player typically removes the elbow guard 10*a* as upper arm/elbow protection is not a focus when running the bases. Rather than handing the elbow guard to a base coach, the player can now use the elbow guard 10*a* in an additional configuration.

The protective guard 10 also functions as a sliding guard 10*b* in a second configuration. As discussed, once the hitter reaches base, the hitter typically removes the elbow guard 10*a* from the arm and gives to a base coach or puts in a pant pocket. As can be appreciated from FIG. 12, the elbow guard 10*a* can now function as a sliding guard 10*b* in a second configuration. The player inserts a hand into the pocket 32 through the opening 34. Depending on which hand the player inserts into the pocket 32, the thumb of the player passes through one of the first aperture 22 and the second aperture 24. It is understood that in additional alternative embodiments, a hood or sleeve member can be supported on an outer surface of the guard 10*b* wherein the thumb of the player is also covered. Notwithstanding the thumb that extends through the aperture 22,24, the hand of the player is covered in the pocket 32. The pocket 32 covers both sides of finger tips of the hand of the player. The hand of the player is thus covered and protected when running bases and, in particular, when sliding into a base as can be appreciated from FIG. 4. With a covered hand, the chances a finger can be snagged and pulled back from awkwardly engaging the base or a fielder attempting to make a tag are minimized. Such instances have resulted in broken fingers or dislocated fingers in past experience. In addition, the sliding guard protects the player's hand and fingers from injury in case of a fielder inadvertently stepping on the hand of the player during play of the game, such as when making a play at a base while the player is sliding into the base.

FIGS. 13-16 disclose another exemplary embodiment of the protective guard having multiple configurations, namely a leg guard in a first configuration and a sliding guard in a second configuration. The protective guard of FIGS. 13-16 is generally designated with the reference numeral 110. The structure of the protective guard 100 is similar to the structure of the protective guard 10 of FIGS. 5-12 and like structures will be referenced with like reference numerals in a 100 series of numerals. The protective guard 100 of FIGS. 13-16 is also designated with the reference numeral 100*a* in the leg guard configuration and the reference numeral 100*b* in the sliding guard configuration.

A main difference in the leg guard 100 of FIGS. 13-16 is that the external layer 120 is formed from a more rigid material similar to the protective layer 116. The external layer 120 or spanning member 120 is dimensioned to span from the first longitudinal side 126 to the second longitudinal side 128. A length of the protective layer 116 is dimensioned to generally correspond to a hand of a player. The external layer 120 is also connected to the cover member 118 in a hinged configuration. To this end, a connection band 150 has one end connected to the external layer 120 and another end connected to the cover member 118 proximate a bottom end of the protective layer 116. The connection band 150 forms a hinge 152 wherein the external layer 120 pivots in relation to the protective layer 116 to be described. It is understood that the connection band 150 may have a width that substantially extends between the first longitudinal side 126 and the second longitudinal side 128 and generally at the distal extension 130. The width of the connection band 150 can vary as desired. The external layer 120 also utilizes a third strap 154 having hook and loop fasteners 156 for securing the external layer 120 in the first configuration to be described below.

In operation and as discussed, the protective guard 10 functions in multiple uses for players. In a first configuration, the protective guard 10 is used by a player when hitting as a leg guard, designated with the reference numeral 110*a*. Thus, prior to entering the batter's box to hit, the player mounts the leg guard 100*a* around lower leg and typically the front leg of the hitter such as shown in FIG. 1. A right-handed hitter mounts the leg guard 110*a* on a left leg and a left-handed hitter mounts the leg guard 110*a* on a right leg. The first and second straps 138,140 wrap around the lower leg and the hook and loop fasteners 142 secure the straps 138,140 to mount the leg guard 110*a* on the lower leg. The external layer 120 is positioned in an extended configuration and generally transverse to the protective layer 116 wherein the external layer 120 rests on top of a foot of the player. The third strap 154 is wrapped around a shoe of the player and fastened using the hook and loop fasteners 156.

The leg guard 110*a* thus protects the player's lower leg when hitting. The external layer 120 provides some protection to the top of the foot of the player. For example, if the player swings a bat at a pitched ball and "fouls the ball off" the bat, the ball can be directed downwards wherein the ball could carom off the lower leg or foot of the player. The leg guard 110*a* provides some protection against such occurrences. The player may reach base via a variety of outcomes such as a hit, a fielder's choice, a fielding error, a base on balls, or a hit by pitch. Upon reaching base, the player typically removes the leg guard 110*a* as lower leg protection is not a focus when running the bases. In addition, wearing the leg guard 110*a* while running the bases can hinder the ability of the player to run the bases as fast as possible. Rather than handing the leg guard to a base coach, the player can now use the leg guard 110*a* in an additional configuration.

The protective guard 110 also functions as a sliding guard 110*b* in a second configuration. As discussed, once the hitter reaches base, the hitter typically removes the leg guard 110*a* from the leg and gives to a base coach or puts in a pant pocket. As can be appreciated from FIG. 16, the leg guard 110 can now function as a sliding guard 110*b* in a second configuration. Once removed from the lower leg, the third strap 154 is wrapped around the external layer 120 and fastened upon itself via the hook and loop fasteners 156. The external layer 120 is pivoted about the hinge 152 of the connection band 150 as shown in FIGS. 14-16 wherein the external layer 120 is positioned between the first longitudinal side 126 and the second longitudinal side 128. In this folded configuration about the connection band 150, the pocket 132 is formed between an inner surface of the external layer 120 and the inner surface of the protective layer 116 that is covered by the cover member 118. The player inserts a hand into the pocket 132 through the opening 134. Depending on which hand the player inserts into the pocket 132, the thumb of the player passes through one of the first aperture 122 and the second aperture 124. It is understood that in additional alternative embodiments, a hood or sleeve member can be supported on an outer surface of the guard 110*b* wherein the thumb of the player is also covered. Notwithstanding the thumb that extends through the aperture 122,124, the hand of the player is generally covered in the pocket 132. The hand of the player is thus covered and protected when running bases and, in particular, when sliding into a base as can be appreciated from FIG. 4. With a covered hand, the chances a finger can be snagged and pulled back from awkwardly engaging the base or a fielder attempting to make a tag are minimized. Such instances have resulted in broken fingers or dislocated fingers in past experience. As discussed above, the sliding guard also protects a player's hand and fingers if inadvertently stepped on by a fielder when making a play at a base while the player is sliding into the base.

The protective guard described herein thus is capable of having multiple uses and can function in a plurality of configurations. It is further understood that the protective guard could also function all as an elbow guard, a leg guard and a sliding guard. It is also understood that the protective guards described herein can have applications outside of a sports environment wherein the guards can function in multiple configurations in other environments.

The protective guard of the present invention provides several benefits. The protective guard functions in multiple configurations. First, the protective guard can function as both an elbow guard and a sliding guard. In addition, the protective guard can function as both a leg guard and a sliding guard. The elbow guard protects the arm from injury when hit with a pitched ball. The leg guard protects the leg from injury when hit with a ball fouled off a bat when hitting. The sliding guard protects fingers from being bent back, dislocated or broken when sliding into a base. The sliding guard also protects fingers and hand from injury when stepped on by a fielder which can happen during play of the game. With the multiple uses of the protective guard, a player does not require two separate guards on the person when hitting. The player does not have to give an elbow guard and/or leg guard to a base coach and pull a sliding guard out of a pant pocket. The player converts the elbow guard and/or leg guard to the sliding guard, which is more efficient and economical as only a single guard is necessary. Players can find it cumbersome to have to hold a sliding guard in a pant pocket when hitting. In addition, a game does not have to be delayed by a player calling time out to give an elbow guard or leg guard to a base coach. Thus, the game can continue without constant delays.

While the invention has been described in its preferred embodiments, it is to be understood that the words which have been used are words of description rather than limitation and that changes may be made within the purview of the appended claims without departing from the true scope and spirit of the invention in its broader aspects.

What is claimed is:

1. A protective guard in the form of a combination protective arm/leg guard and sliding guard for a baseball player comprising:

a base member defining a rigid protective layer, the base member further defining a first longitudinal side and a second longitudinal side wherein the base member defines a curvature between the sides, the base member having an aperture therethrough;

an external layer connected to the base member between the first longitudinal side and the second longitudinal side wherein a pocket is formed between the base member and the external layer; and, a connector assembly connected to the base member, the connector assembly having a strap member having a hook and loop fastener thereon, wherein the guard has a first configuration configured to be worn by the player on one of an arm of the player wherein the strap is configured to be wrapped around and fastened around the arm by the hook and loop fastener, wherein the guard functions as an elbow guard, and a leg of the player wherein the strap is configured to be wrapped around and fastened around the leg by the hook and loop fastener, wherein the guard functions as a shin guard, and wherein the guard has a second configuration configured to worn by the player wherein the player inserts a hand into the pocket and wherein the aperture is configured to receive a thumb of the player, wherein the guard functions as a sliding guard, wherein the aperture comprises a pair of apertures, a first aperture in the base member spaced away from a second aperture in the base member, wherein the first aperture is configured to receive a right-hand thumb of the player and the second aperture is configured to receive a left-hand thumb of the player.

2. The protective guard of claim 1 wherein the pocket is dimensioned to receive and cover fingers of the player.

3. The protective guard of claim 1 wherein the base member has a cover member positioned over the protective layer.

4. The protective guard of claim 1 wherein the base member has a distal extension.

5. The protective guard of claim 1 wherein the strap member comprises a first strap member and a second strap member, the second strap member spaced away from the first strap member.

6. The protective guard of claim 1 wherein the protective layer is made from a rigid plastic material.

7. The protective guard of claim 1 wherein the pocket defines an opening proximate an intermediate location of the base member.

8. The protective guard of claim 7 wherein the pocket defines a closed end at a distal end of the base member.

9. The protective guard of claim 1 wherein the external layer is a resilient and flexible layer.

10. A protective guard in the form of a combination protective arm/leg guard and sliding guard for a baseball player comprising:

a protective layer configured to be worn by the baseball player, the protective layer having a first aperture and a second aperture spaced away from the first aperture, the guard having a first configuration configured to be worn on one of an arm of the player wherein the guard functions as an elbow guard and a leg of the player wherein the guard functions as a shin guard, and a second configuration configured to be worn on a hand of the player, wherein the first aperture is configured to receive a right-hand thumb of the player and the second aperture is configured to receive a left-hand thumb of the player wherein the guard functions as a sliding guard.

* * * * *